US010982388B2

(12) United States Patent
Muhli

(10) Patent No.: US 10,982,388 B2
(45) Date of Patent: Apr. 20, 2021

(54) METHOD AND ARRANGEMENT FOR GENERATING PROCESS STEAM

(71) Applicant: ANDRITZ OY, Helsinki (FI)

(72) Inventor: Aki Muhli, Kotka (FI)

(73) Assignee: .Andritz Oy, Helsinki (FI)

( * ) Notice: Subject to any disclaimer, the term of this patent is extended or adjusted under 35 U.S.C. 154(b) by 11 days.

(21) Appl. No.: 16/094,108

(22) PCT Filed: Apr. 19, 2017

(86) PCT No.: PCT/FI2017/050295

§ 371 (c)(1),
(2) Date: Oct. 16, 2018

(87) PCT Pub. No.: WO2017/182713

PCT Pub. Date: Oct. 26, 2017

(65) Prior Publication Data

US 2019/0127910 A1 May 2, 2019

(30) Foreign Application Priority Data

Apr. 22, 2016 (FI) ..... 20165352

(51) Int. Cl.
*D21C 11/06* (2006.01)
*D21C 1/02* (2006.01)
(Continued)

(52) U.S. Cl.
CPC ..... *D21C 11/06* (2013.01); *D21C 1/02* (2013.01); *D21C 7/10* (2013.01); *F22B 1/12* (2013.01); *F22D 1/18* (2013.01); *D21B 1/14* (2013.01)

(58) Field of Classification Search
CPC ..... D21C 11/0014; D21C 7/10; D21C 11/06
See application file for complete search history.

(56) References Cited

U.S. PATENT DOCUMENTS 4,111,743 A 9/1978 Rönnholm
5,507,141 A 4/1996 Stigsson
(Continued)

FOREIGN PATENT DOCUMENTS

CA 2 298 426 8/2000
WO 2016/038247 3/2016

OTHER PUBLICATIONS

Gullichsen editor, Chemical Pulping 6B, 1999, Fapet Oy, B53-B54, B70-B72. (Year: 1999).*
(Continued)

*Primary Examiner* — Anthony Calandra
(74) *Attorney, Agent, or Firm* — Nixon & Vanderhye P.C.

(57) ABSTRACT

A method and an arrangement for generating process steam at a chemical pulp mill. Water is heated by subjecting it to an indirect heat exchange contact with steam in a heat exchanger. The water is heated with live steam produced in a steam boiler for generating process steam, whereby the live steam is condensed and the generated condensate is recovered. The process steam is subjected to a direct heat exchange contact with a material for heating the material. The water used for process steam production is obtained from secondary condensates, purified waste water and/or raw water. Process steam can be used in the treatment of cellulosic fibrous material, such as chips.

18 Claims, 1 Drawing Sheet

(51) Int. Cl.

| | |
|---|---|
| ***F22B 1/12*** | (2006.01) |
| ***F22D 1/18*** | (2006.01) |
| ***D21C 7/10*** | (2006.01) |
| *D21B 1/14* | (2006.01) |

(56) References Cited

U.S. PATENT DOCUMENTS

| | | | | |
|---|---|---|---|---|
| 6,306,252 | B1 | 10/2001 | Ryham | |
| 8,512,514 | B2 | 8/2013 | Tikka et al. | |
| 2008/0293114 | A1 | 11/2008 | Foody et al. | |
| 2010/0236733 | A1* | 9/2010 | Tikka | D21C 7/00 162/68 |
| 2019/0218712 | A1* | 7/2019 | Olsson | D21C 3/24 |

OTHER PUBLICATIONS

Armstrong, The Armstrong Humidification book, 1995, Armstrong International. (Year: 1995).*
International Search Report for PCT/FI2017/050295, dated Oct. 4, 2017, 3 pages.
Written Opinion of the ISA for PCT/FI2017/050295, dated Oct. 4, 2017, 7 pages.

* cited by examiner

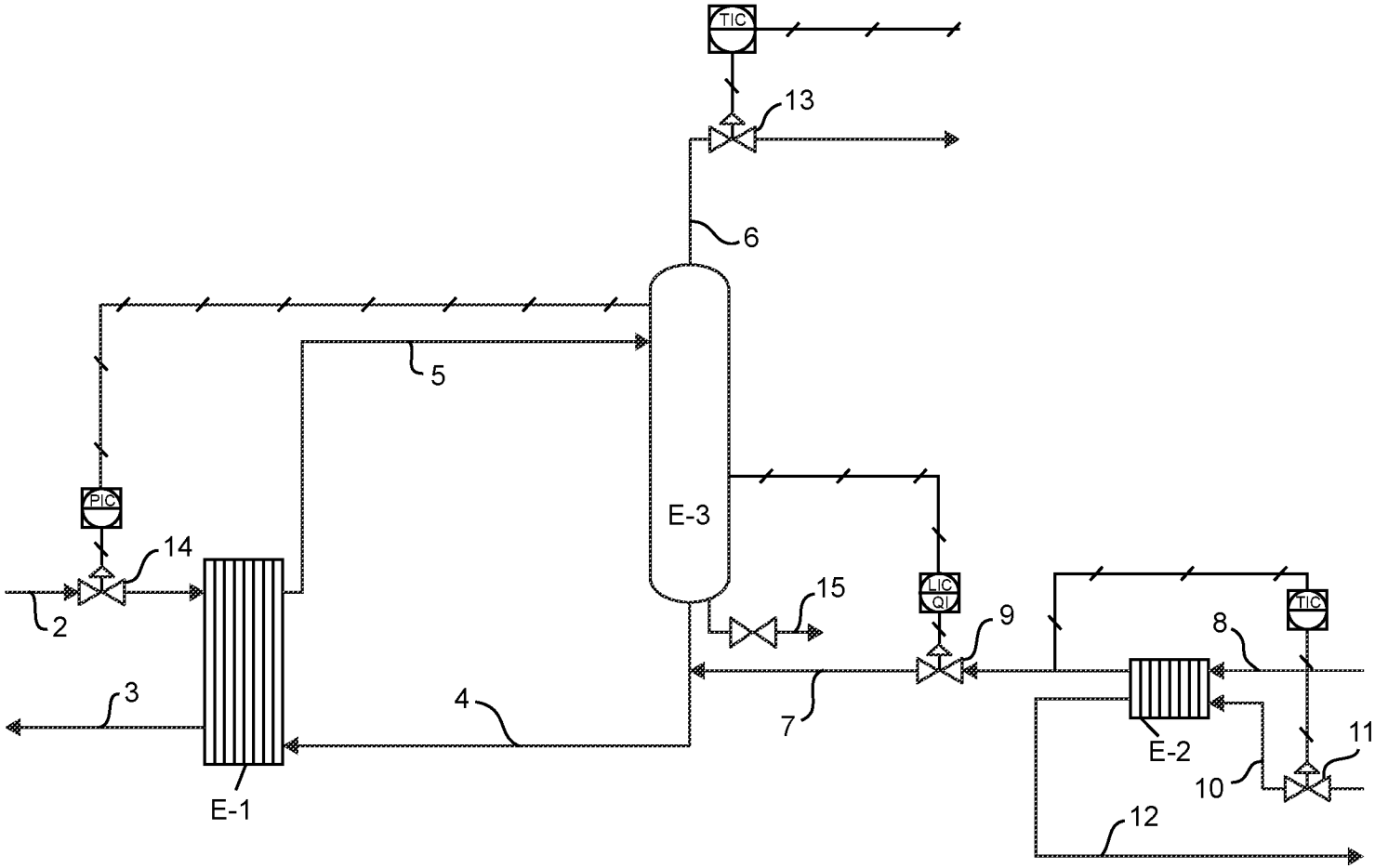
TIC
13
6
E-3
15
5
4
PIC
14
2
3
E-1
TIC
QI
9
7
TIC
8
E-2
10
11
12

METHOD AND ARRANGEMENT FOR GENERATING PROCESS STEAM

RELATED APPLICATIONS

This application is a U.S. national phase of International Application No. PCT/FI2017/050295 filed Apr. 19, 2017, which designated the U.S. and claims priority to Finnish Patent Application 20165352 filed Apr. 22, 2016, the entire contents of these applications are incorporated by reference.

BACKGROUND AND SUMMARY OF INVENTION

The present invention relates to a method and an arrangement for generating process steam and working steam at a chemical pulp mill.

Prior art utilizes a fiberline system with a chip bin, where wood chips or other cellulosic material is steamed and liquid is admixed therein for forming a slurry, after which the slurry is pressurized, fed into a treatment vessel or treatment vessels (which may be an impregnation vessel, a prehydrolysis process or other treatment), after which follows a digester. At present, at least one black liquor stream is discharged from the cooking system (typically at a temperature of 120-170° C.). The discharged black liquor stream or streams is/are used as a heat source for preheating white liquor, other black liquor streams being led to feed and cooking systems and/or other liquid streams. The discharged black liquor stream or streams is/are then led into one or more flash tanks, wherein steam is generated from hot black liquor as it is cooled, typically to a temperature of approximately 100-120° C. In this stage the black liquor is led to an evaporator system of the recovery zone. The thus generated flash steam can be used at another location in the pulping process. Flash steam can e.g. be used for direct preheating of chips prior to cooking.

The above described flashing process, although being used successfully in traditional continuous digesters, has the drawback that the generated steam contains volatile compounds, including sulfur compounds, which are not desirable in wood chip presteaming. Typically, wood chips are steamed at atmospheric or slightly higher pressure so that residual gases are not absorbed into the wood chips, but they are collected and treated. The treatment is typically combustion in the noncondensable gas (NCG) system of the mill. This collection and treatment system becomes especially significant when the steam that is used contains volatile compounds, which have an undesirable environmental impact, including noxious odor. Therefore, it is advantageous to use such a steam source that minimizes or eliminates the introduction of volatile compounds into the chip steaming process. In addition, an explosion risk exists, if concentrated gases entrained in flash steam are introduced into low concentration gases.

In batch digesters live steam is typically used also in conjunction with chip loading. An advantage of chip loading with steam is an increase in the packing level and temperature of the chips. Steam is also used for steaming chips.

Known solutions offer various systems for producing cleaner steam for the heating needs of a digester plant and for improving the energy economy of a chemical pulp mill. Publication U.S. Pat. No. 6,306,252 describes a method of producing steam and for recovering energy from spent cooking liquor by leading the liquor together with an evaporable liquid, advantageously clean water, into heat exchange relationship in a liquid/liquid heat exchanger for heating the liquid. Then the pressure of the heated liquid is decreased in a flashing vessel for producing clean steam. The clean liquid can be heated by means of the heat of black liquor also in an evaporator or a reboiler, such as a kettle reboiler, for producing steam.

U.S. Pat. No. 8,512,514 discloses a process where two black liquor streams are withdrawn from the digester. One of the black liquor streams extracted from the digester is flashed, whereby flashed black liquor and flash vapor are generated, and the other black liquor stream is evaporated using live steam as heating medium, whereby steam needed in the digester process and evaporated black liquor are generated. Flash vapor generated in the flashing of the second black liquor stream extracted from the digester is led into at least one heat exchanger, preferably a vapor reboiler, into an indirect heat exchange contact with clean liquid being evaporated for producing clean steam that is used for steaming chips.

The above solutions have often been used in an attempt to avoid using flash vapor in chip treatment, such as in a chip bin, because it causes odor problems and an explosion risk. Therefore reboiler solutions are favored, comprising for instance a kettle reboiler or a vapor reboiler. A disadvantage of a kettle reboiler is that the dry-solids content of black liquor does not increase therein, which increases evaporation of water at the evaporation plant and thus impairs the energy economy of the chemical pulp mill.

A problem with a vapor reboiler is that in certain cases, especially in winter, it is not always possible to generate an adequate amount of steam required for chip treatment, such as in a chip bin, but live steam of the mill, such as low pressure steam has to be used in addition. This can take place by feeding live steam directly into the chips. Sometimes live steam is used as a sole heat source in chip treatment, in a digester and also other processes of a chemical pulp mill.

Live steam is typically obtained from steam turbines of the mill, which are supplied superheated steam produced from boiler water from the boiler plant, e.g. from a chemical recovery boiler. Direct use of live steam e.g. in chip treatment is not always advantageous in view of water consumption and energy efficiency. Condensing of live steam into the chips or other material being treated prevents recovery of condensate for reuse, and thus increases the consumption of expensive boiler water.

An object of the present invention is to eliminate the above mentioned problems and to provide an advantageous method and arrangement for producing process steam and working steam, which can be used instead of live steam in an object of application, such as in a digester plant of a chemical pulp mill. Especially in such an object of application, where it is not possible to recover steam condensate.

The present invention relates to a method of producing process steam at a chemical pulp mill, in which method water is heated by indirect heat exchange contact with steam in a heat exchanger. It is characteristic of the invention that the water is heated with live steam generated in a steam boiler for producing process steam, whereby the live steam is condensed and condensate thus generated is subjected to a direct heat exchange contact with a material for treating the material.

The present invention also relates to an arrangement for producing process steam at a chemical pulp mill. The arrangement comprises an indirect heat exchanger having a heating steam inlet conduit, a heating steam condensate outlet conduit, an inlet conduit for water to be evaporated and an outlet conduit for produced steam and water. The heating steam inlet conduit is connected to a live steam line of the mill, the condensate outlet conduit is connected to a clean condensate recirculation system of the mill, and the outlet conduit for steam and water is connected to a separation tank having a steam outlet conduit that is connected to a usage point where steam is used.

According to an embodiment, a liquid circulation is arranged between a heat exchanger and the separation tank, which liquid circulation is connected to a water source comprising secondary condensate, raw water and/or purified waste water. According to an embodiment the arrangement comprises a preheater for preheating a liquid to be fed into the liquid circulation.

In accordance with the present invention, the consumption of live steam produced in a steam boiler, such as in a chemical recovery boiler, as well as the consumption of boiler water can be decreased. With the novel method and apparatus it is possible to recover and recirculate clean live steam condensate back to the boiler plant for use as boiler water. Process steam can be used for heating various process streams, such as for heating cellulosic fibrous material, filtrates or liquors. Process steam can be subjected to a direct heat exchange contact with a cellulosic fibrous material, such as chips or chip slurry for treating the material. Chemical pulp mill often use direct steam in chip bins, chip feed apparatuses, at the top of the digester and in other direct steam applications, where process steam produced in a novel way can now be used both in a batch digester plant and in a continuous digester plant. Process steam can also be used for heating filtrate and liquor streams in a chemical pulp mill.

Process steam is produced from water, which advantageously is a water fraction substantially free from volatile compounds, which water fraction comprises raw water, secondary condensates and treated waste water, typically clarified waste water. The treatment of raw water can include clarification and/or filtration for removing solids, depending on the source of the raw water. Waste water of a chemical pulp mill is typically treated in a mechanical biological waste water purification plant. The main steps of the purification process are preliminary clarification, aeration, and final clarification. In the solution according to the invention, waste water subjected to final clarification can be used for producing process steam. Waste water from the chemical pulp mill purified in another way can also be used. The solution according to the present invention does not use boiler water or demineralized water as a source for process steam.

Process steam is produced in an indirect heat exchanger, in which live steam produced in a steam boiler and water are subjected to an indirect heat exchange contact. The heat exchanger can preferably be formed of a rising film heat exchanger comprising a number of plate-like heat exchange elements. The heat exchanger can also be a vertical tube heat exchanger, in which the heating steam flows outside the tubes and the liquid being boiled flows inside the tubes. In the heat exchanger the heating steam heats the "clean" liquid that is adequately free from volatile compounds to a temperature that is higher than its boiling point for producing steam. The liquid can typically be condensate of the mill, raw water or purified waste water, or other adequately clean water fraction, as described above. The steam produced in a heat exchanger contains a substantially smaller amount of noncondensable gases than steam produced by flashing of black liquor, which is also used as heating steam.

According to an essential feature of the invention, clean condensate generated from live steam in a heat exchanger can be led back into a clean condensate recirculation system of the mill and further into a feed water tank of the boiler. The live steam that is used is typically low pressure steam or intermediate pressure steam.

The steam produced from water in a heat exchanger is preferably led into a separation tank having two phase zones, both in liquid and in steam state. The steam stream discharged from the heat exchanger contains water, whereby the portion of steam is typically approximately 50-60% at the most. In the steam zone of the tank, water droplets are separated from the steam stream, which droplets settle into the liquid space at the lower part of the tank due to gravitation. The steam is led into further use via an outlet conduit at the upper part of the tank. The upper part of the tank is typically provided with a droplet separation device for intensified water separation. In the lower part of the tank is a liquid space, from where water is led into the heat exchanger for producing steam.

The separation tank is pressurized, and the steam space typically takes 25-50% of the overall volume of the tank. The liquid level in the tank is controlled by introducing additional water into the tank or into a liquid line between the tank and a heat exchanger. Preferably this water is preheated in a preheater heat exchanger with a suitable hot process stream. Advantageously this kind of process stream is a black liquor stream discharged directly from the digester, which stream is led from the preheater into the evaporation plant. Upstream of the preheater, heat can be recovered from the black liquor in the heat recovery system of the digester, such as in flashing vessels or in hot accumulators. Flashed black liquor vapor can also be used as heating medium in a preheater.

The liquid level in the separation tank is preferably higher than the upper level of the preheater. Then no pump is needed to transfer water in the water circulation of the separation tank and the preheater.

From the separation tank the steam produced in the heat exchanger is led into the usage point, which typically is such that there is no need for condensate recovery. The pressure of the steam being discharged is dependent on the usage point. Typically the pressure is 2-15 bar. Typical usage points at a chemical pulp mill are chip pretreatment and steaming, chip feeding apparatuses and chip heating at the top of the digester. The steam outlet line can be provided with a regulation valve, which regulates the flow of steam into the usage point according to the set value of temperature prevailing in the usage point, such as in a chip bin.

The separation tank can be provided with a blow down system, via which water can be discharged for preventing the accumulation of salts and other undesirable substances in the water circulation between the separation tank and the heat exchanger. This can be needed especially when the water is not condensate from the evaporation plant. The blow down line can be provided with a timer for implementing the blow down operation periodically as needed. The water inlet line can be provided with a filter for preventing noxious particles from entering the separation tank.

The present method and apparatus are described in more detail with reference to the appended FIGURE.

FIG. 1 illustrates schematically a preferred arrangement according to the invention.

Process steam is produced in an indirect heat exchanger E-1, in which low pressure steam or intermediate pressure steam introduced from a steam boiler and water are subjected to an indirect heat exchange contact. Live steam is introduced via line 2 into the heat exchanger. The heat exchanger can be a plate heat exchanger, e.g. of the rising film type. The water to be heated is introduced via line 4. In the heat exchanger the heating steam heats the water for producing process steam, which is discharged via line 5.

Clean condensate generated from live steam in the heat exchanger E-1 is led via line 3 into the clean condensate recirculation system of the mill and further into the feed water tank of the boiler.

From the heat exchanger E-1 the process steam is led further via line 5 into a separation tank E-3 having two phase zones, both in liquid and in steam state. In the steam space of the tank, water droplets are separated from the steam stream, which droplets settle into the liquid space in the lower part of the tank. The process steam is led into further use via an outlet conduit 6 in the upper part of the tank E-3. The upper part of the tank is typically provided with a droplet separation device (not shown) for intensified water separation. In the outlet conduit the steam flow is regulated with a valve 13, which is controlled according to the temperature of the usage point, e.g. a chip bin. The flow of live steam is regulated with a regulation valve 14 for providing an adequate amount and pressure for the produced process steam in the separation tank. The required pressure and amount are dependent on the usage point of the process steam.

The lower part of the separation tank E-3 is provided with a liquid space, from where water is led into the heat exchanger E-1 via line 4 for producing steam. Between the separation tank E-3 and the heat exchanger E-1 is arranged a liquid circulation formed of lines 4 and 5, since water is returned with the steam into the separation tank.

The liquid level in the separation tank is controlled by introducing feed water via line 7 into the tank or into line 4. The liquid level regulation comprises a regulation valve 9 for controlling the water flow and thus for maintaining a suitable liquid level in the separation tank.

The feed water of line 7 is heated in a preheater heat exchanger E-2 with a suitable hot process stream from line 10. The preheater can be e.g. a plate heat exchanger. The volume of hot process stream is regulated with a valve 11, which control is based on temperature measurement in the preheated water line 7. Advantageously this kind of process stream is a black liquor stream discharged directly from the digester, which stream is via line 12 led from the preheater E-2 into the evaporation plant. Upstream of the preheater, heat can be recovered from the black liquor in the heat recovery system of the digester, such as in flashing vessels or in hot accumulators.

The water being fed into the preheater via line 8 can typically comprise condensate, raw water, purified waste water or other adequately clean waste water fraction from the mill. Thus, the steam produced in the heat exchanger E-1 contains a substantially smaller amount of non-condensable gases than steam produced by direct flashing of black liquor, which is also used as heating steam.

The separation tank E-3 can be provided with a blow down line 15, via which water can be discharged for preventing the accumulation of salts and other undesired substances in the water circulation between the separation tank and the heat exchanger.

Advantages provided by the invention:

live steam condensate can be recovered, water consumption at the mill decreases, when clean live steam condensate is returned to be used as boiler water, production of demineralized water decreases, and waste water amount decreases.

The invention claimed is:

1. A method of producing process steam at a chemical pulp mill, the method comprising:

heating water in a heat exchanger in which the water is subjected to indirect heat exchange contact with live steam produced in a steam boiler, wherein the water is free of volatile compounds and the heated water is output from the heat exchanger as process steam, condensing the live steam in the heat exchanger and recovering condensate resulting from the condensing of the live steam, and heating a material by direct heat exchange contact between the material and the process steam output from the heat exchanger.

2. The method according to claim 1, wherein the water to be heated in the heat exchanger to produce the process steam is at least one of: purified waste water and raw water.

3. The method according to claim 1, further comprising preheating the water to be heated to produce the process steam with a hot liquid stream before the step of heating the water.

4. The method according to claim 1, further comprising separating the water to be heated to produce the process steam from the process steam in a separation tank, wherein an upper part of the separation tank includes a steam space and a lower part of the separation tank includes a liquid space.

5. The method of claim 4, wherein the process steam is discharged from the separation tank and the step of heating the material includes direct heat exchange contact between the process steam and chips in a chip bin.

6. The method according to claim 1, wherein the step of heating a material includes using the process steam to directly heat cellulosic fibrous material.

7. The method of claim 1, wherein the step of heating the material includes direct heat exchange contact between the process steam and chips in a chip bin.

8. A method of producing process steam at a chemical pulp mill, the method comprising:

heating water in a heat exchanger in which the water is subjected to indirect heat exchange contact with live steam produced in a steam boiler, and outputting the heated water from the heat exchanger as process steam, condensing the live steam in the heat exchanger and recovering condensate resulting from the condensing of the live steam, heating a material by direct heat exchange contact between the material and the process steam output from the heat exchanger, and preheating the water to be heated to produce the process steam with black liquor discharged from a digester or flash steam from the black liquor.

9. The method according to claim 8, wherein the water is fed into the heat exchanger from a separation tank, whereby the process steam flows from the heat exchanger to the separation tank and the water flows from the separation tank to the heat exchanger.

10. A method to produce process steam in a chemical pulp mill, the method comprising:

feeding live steam generated in a boiler into a heat exchanger, condensing the steam in the heat exchanger, and outputting condensate of the steam from the heat exchanger;

feeding water free of volatile compounds into the heat exchanger, heating the water in the heat exchanger to produce process steam using heat energy extracted from the steam condensed in the heat exchanger;

outputting the process steam from the heat exchanger into a conduit which directs the process steam into a separation tank in which a portion of the process steam condenses into water;

outputting the process steam from the separation tank into a conduit which directs the process steam to directly heat a process material being processed in the chemical pulp mill; and outputting from the separation tank the water condensed in the separation tank as the water fed into the heat exchanger.

11. The method of claim 10 further comprising circulating the water and process steam between the heat exchanger and the separation tank.

12. The method of claim 10 further comprising adding additional water to the water being fed into the heat exchanger, wherein the additional water is sourced from at least one of a secondary condensate, raw water and purified waste water.

13. The method of claim 12 further comprising heating the additional water with heat extracted from black liquor output from a digester in the chemical pulp mill.

14. The method of claim 13 wherein the heating of the additional water is in a second heat exchanger which receives the black liquor and separates the black liquor from the additional water.

15. The method of claim 10 further comprising regulating a flow of the steam fed into the heat exchanger based on a desired pressure and/or amount of the process steam outputted from the separation tank.

16. The method of claim 10 wherein the heat exchanger separates the live steam fed into the heat exchanger from the water and process steam flowing through the heat exchanger.

17. The method of claim 10 wherein the live steam fed to heat exchanger is supplied from a steam boiler and the condensate of the steam condensed in the heat exchanger flows into the steam boiler.

18. A method to produce process steam in a chemical pulp mill, the method comprising:

feeding steam produced in a boiler into a heat exchanger, condensing the steam in the heat exchanger, and outputting condensate of the steam from the heat exchanger;

feeding water into the heat exchanger, heating the water in the heat exchanger to produce process steam using heat energy extracted from the live steam condensed in the heat exchanger;

outputting the process steam from the heat exchanger into a conduit which directs the process steam into a separation tank in which a portion of the process steam condenses in water;

outputting the process steam from the separation tank into a conduit which directs the process steam for use in the chemical pulp mill, wherein the process steam output from the separation tank is applied to heat chips in a chip bin, and outputting from the separation tank the water condensed in the separation tank for use as the water fed into the heat exchanger.

* * * * *